United States Patent [19]

Karrfalt

[11] Patent Number: 4,936,071

[45] Date of Patent: Jun. 26, 1990

[54] METAL ROOF REROOFING SYSTEM AND METHOD

[75] Inventor: H. A. Karrfalt, Noblesville, Ind.

[73] Assignee: Bridgestone/Firestone Inc., Akron, Ohio

[21] Appl. No.: 402,720

[22] Filed: Sep. 5, 1989

[51] Int. Cl.[5] ..... E04B 2/00

[52] U.S. Cl. ..... 52/420; 52/459; 52/520; 52/543

[58] Field of Search ..... 52/520, 521, 537, 543, 52/410, 417, 419, 420, 459

[56] References Cited

U.S. PATENT DOCUMENTS

| | | | |
|---|---|---|---|
| 3,401,493 | 9/1968 | Lindner | 52/309.8 |
| 3,511,007 | 5/1970 | Babcock | 52/309.8 |
| 3,654,005 | 4/1972 | Higgins et al. | 156/108 |
| 3,667,185 | 6/1972 | Maurer | 52/537 |
| 3,857,212 | 12/1974 | Barnett | 52/459 X |
| 4,146,672 | 3/1979 | Jasperson | 52/517 X |
| 4,437,283 | 3/1984 | Benoit | 52/410 |
| 4,445,305 | 5/1984 | Orie, Sr. | 52/309.9 |
| 4,601,935 | 7/1986 | Metcalf et al. | 428/57 |
| 4,732,635 | 3/1988 | Levens | 156/230 |

FOREIGN PATENT DOCUMENTS 6280027 4/1987 Japan .

*Primary Examiner*—Carl D. Friedman
*Assistant Examiner*—Linda J. Hoffert
*Attorney, Agent, or Firm*—Ronald Brietkrenz

[57] ABSTRACT

A reroofing system and method for weatherproofing the metal panels which are attached to an existing roof deck by series of fasteners. A tape laminate formed of butyl rubber and unvulcanized EPDM is applied over the series of fasteners and over the seams formed by adjacent and overlapping panels to provide a weatherproof seal therefor. The butyl rubber has sufficient natural tackiness to secure the EPDM to its top surface and to secure the bottom surface of the tape to the metal panels. The tape laminate has an elongation of approximately 600% and thus is unaffected by panel and building movements. A coating of an acrylic paint may be applied over the tape laminate and remaining surfaces of the roof panels to increase the weatherproofing effectiveness thereof and to provide an aesthetically pleasing appearance.

12 Claims, 1 Drawing Sheet

METAL ROOF REROOFING SYSTEM AND METHOD

BACKGROUND OF THE INVENTION

1. Technical Field

The invention relates to reroofing systems and methods of weatherproofing and sealing existing metal roofs and the fasteners which secure the metal panels to a roof deck. More particularly, the invention relates to such a reroofing system and method in which a highly flexible tape laminate having a pressure sensitive adhesive on one side covers the seams formed by adjacent panels and the fasteners to provide a weatherproof roof covering for metal roofs.

2. Background Information

Metal roofing systems for buildings usually consist of a plurality of metal panels which are overlapped at their ends and are secured to a roof deck or building structure by nails, screws, clips or other type fasteners. These metal roofs find applications in many building constructions, principally commercial and industrial buildings. However, the metal panels are subject to considerable movement together with the building, due to the expansion and contraction of the panels by heat, cold, wind etc., making it extremely difficult to provide a satisfactory weatherproof seal along the seams and at the fastener locations since over time the panels and their seams become loose.

Another common type of roofing construction is a single ply BUR (Built Up Roof System) which uses asphalt as an adhesive for attaching various types of membranes, such as felt or the like, to the metal roof panels. Although these systems are satisfactory for certain applications, the contraction and expansion of the roof panels often results in cracking of the roof covering along the seams and fastener locations, subjecting the roof to possible leakage. Also, these prior art roof constructions are relatively expensive to install and maintain and also increase the weight which must be supported by the roof surface. Also the use of hot asphalt may be prohibited by some local building codes. Therefor for many applications, such as for metal buildings, a roof of overlapping metal panels provide an inexpensive and satisfactory roofing system. However, these metal roofs are subject to the problems discussed above.

However, the reroofing of such metal roofs is required over time but is difficult since applications of other known roofing systems would require insulation layers or possibly a wood layer to accept the new roof. The relatively light gauge of the existing roof panels makes this additional layer difficult and expensive to apply effectively. Also the subsequent movement of the roof deck still causes cracks in the new roof.

Pressure sensitive adhesive tapes have been used in the roofing industry, primarily for adhering together flexible roof membrane or to adhere the flexible membrane to attaching devices. Also, such tapes have been applied to the roof flashing to provide a waterproof joint therebetween. Other types of sealing tapes and roofing attachments are shown in the following patents.

U.S. Pat. No. 4,732,635, discloses a method of making spliceable sheet material, wherein a transfer tape is applied to a sheet of uncured EPDM rubber membrane, and the assembly is subjected to heat and pressure to melt the adhesive and bond it to the membrane.

U.S. Pat. No. 4,601,935, discloses a roof seaming tape compound which contains butyl rubber and polyisobutylene. The tape is used to seal two EPDM membranes to each other along their respective adhesively-primed seams.

U.S. Pat. No. 3,654,005, discloses a thermoplastic sealing tape for window glass, which can be comprised of an EPDM rubber with a tackifier.

U.S. Pat. No. 4,437,283 discloses a roofing system of the batten type which uses sealing tape for securing the covering membrane to the roof and for sealing flanges of the end members with the roof sheet.

Japanese Patent No. 62-080027, discloses a tacky tape used to join two free adjacent ends of waterproof sheets in which the tape has a self-adhesive property and contains a butyl rubber.

However, none of these patents disclose the use of a tape laminate formed of butyl rubber and EPDM, in which the butyl rubber provides a pressure sensitive adhesive for securing the EPDM to the top surface of the butyl rubber and for securing the bottom surface to the metal panel seams and fastener locations to provide a weatherproof reroofing system for an existing metal roof.

SUMMARY OF THE INVENTION

Objectives of the invention include providing a reroofing system and method for sealing the metal panels of an existing metal roof along the seams thereof and over the attachment fasteners with a sealing tape to provide a weatherproof seal.

Another objective of the present invention is to provide such a reroofing system and method for metal roofs in which the tape is a laminate formed of a top layer of EPDM which provides a non-tacky top surface to the tape, and which has a bottom layer of butyl rubber, wherein the natural tackiness of the rubber secures the EPDM to the rubber and the tape laminate to the roof panels.

A further objective of the present invention is to provide such a reroofing system and method for metal roofs in which the tape laminate has a high elongation factor, preferably up to 600%, enabling the tape to stretch and contract with the expansion and contraction of the metal panels caused by temperature changes and wind effect, in order to maintain a permanent and effective seal with the adjacent panels.

Still another objective of the present invention is to provide such a reroofing system and method for metal roofs in which the unvulcanized EPDM top strip of the tape laminate becomes partially cured after installation on the roof by being exposed to the sun and heat, whereby the tape becomes elastic to increase its sealing effectiveness at the panel seams and fastener locations.

A further objective of the present invention is to provide a relatively inexpensive, simple, fast and efficient metal roof reroofing system and method of weatherproofing the seams formed between adjacent metal panels and the panel attachment fasteners therefor, wherein no tools or external power for operating the same or excessive labor are required.

Still another objective of the present invention is to provide such a reroofing system and method for metal roofs which complies with existing building code requirements, and which eliminates the use of hot asphalt and other heretofore used roofing materials.

A further objective of the present invention is to provide such a reroofing system and method for metal roofs in which a layer of an acrylic paint can be applied over the tape laminate and remaining areas of the roof panels to increase the weatherproofing effect provided thereby, and to provide an aesthetically attractive roof.

These objectives and advantages are obtained by the metal roofing system of the invention, the general nature of which may be stated as including a plurality of sheet metal panels attached to a structure of a building and forming seams at the junction of adjacent panels; and strips of an adhesive tape laminate positioned over the seams of the adjacent panels to form a weatherproof seal thereto.

These objectives and advantages are further obtained by the improved method of the invention, the general nature of which may be stated as a method for reroofing an existing metal roof of the type having a plurality of sheet metal panels secured to a structure of a building in an overlapping relationship by a series of fasteners and forming seams at the junction of adjacent panels, including the step of applying strips of an adhesive tape laminate over the seams of the adjacent metal panels and over the series of fasteners to form a weatherproof seal therefor.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENTS

Figure 1:
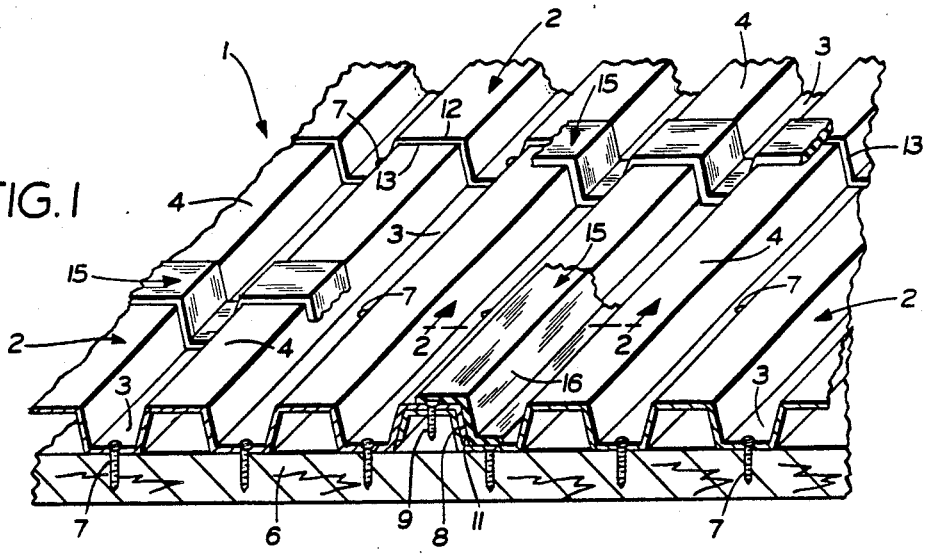
FIG. 1 is a fragmentary diagrammatic view of a portion of an existing metal roof using the reroofing system and method of the invention.
Figure 2:
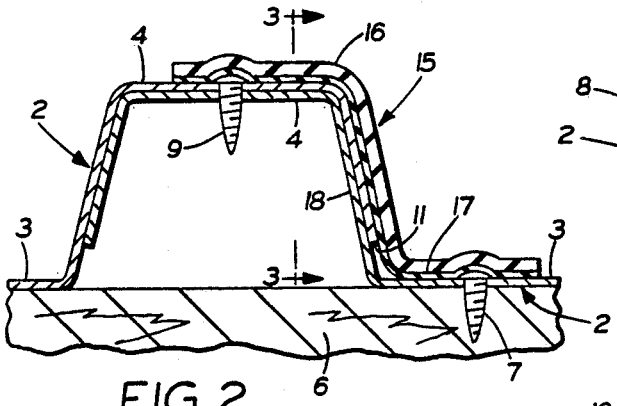
FIG. 2 is a greatly enlarged fragmentary sectional view taken on line 2—2, FIG. 1.
Figure 3:
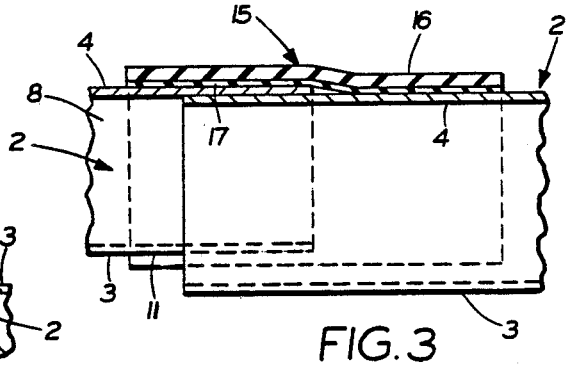
FIG. 3 is a fragmentary sectional view taken on line 3—3, FIGS. 2.

A first type of metal roof with which the improved reroofing system and method of the present invention is used, is indicated generally at 1, and is shown in FIGS. 1-3. Metal roof 1 includes a plurality of similar sheet metal panels, each of which is indicated generally at 2, each being formed by a plurality of alternating flutes or grooves 3 and ridges 4.

Panels 2 are attached to a roof deck 6 or other building structure, by a plurality of fasteners 7 which are usually metal screws, nails or the like. Adjacent panels 2 have their terminal longitudinally extending ends 8 overlapped by the end most ridge of the adjacent panel as shown particularly in FIG. 2. Adjacent panels are secured to each other by a plurality of sheet metal screws 9 or other fasteners. This overlapping relationship forms a longitudinally extending seam 11.

Also, the transverse ends 12 of adjacent panel are overlapped as shown in FIG. 1, forming a seam 13 which extends transversely to the longitudinal direction of the flutes and ridges of each panel. Typically one or more series of fasteners 7 are applied through flutes 3 as shown in FIGS. 1 and 2 to assist in securing the metal panels to roof deck 6. Seams 11 and 13 as well as the location of each fastener 7, presents a possible area of water leakage for the roof structure and must be properly sealed during the reroofing thereof to provide a weatherproof roof. The particular attachment and construction of metal panels 2 and roof deck 6, as well as fastener 7, may change from that shown in FIGS. 1-3, without effecting the main concept of the invention described below.

In accordance with the reroofing system and method of the invention, a tape laminate indicated generally at 15, is applied along and over seams 11 and 13 to provide a weatherproof seal therefor. Tape 15 is a laminate formed by a top layer 16 of EPDM and a bottom layer 17 of butyl rubber. Top layer 16 preferably is twice the thickness of bottom layer 17. Bottom layer 17 of butyl rubber is formed predominately of polyisobutylene and has sufficient natural tackiness to provide a pressure sensitive adhesive characteristic. This adhesive enables top layer 16 of EPDM to be firmly secured to bottom layer 17 without requiring any additional adhesive and most importantly, enables the tape laminate to be secured to the metal panel surfaces without any additional adhesive or other fasteners.

As shown in FIG. 2, tape laminate 15 preferably extends along the major portion of ridge 4, along a sidewall 18 of the panel, and along the groove 3 thereof so as to provide a complete covering for seam 11 and sufficiently to cover fasteners 7 and 9.

As shown in FIG. 1, tape 15 also provides a complete weatherproof cover for the series of fasteners 7 not located at a seam location, to prevent water from seeping in and around the head and shanks of the fasteners where they penetrate the roof panels.

Tape laminate 15 thus provides a sealing strip which has as a non-tacky top surface and a bottom surface having sufficient natural tackiness to secure and maintain the strip on the roof panels, and has an elongation factor of approximately 600%. This high elongation factor enables the tape to stretch with the expansion and contraction of the roof metal panels caused by heat, wind and the like, enabling the tape to maintain sealing contact with the adjacent panels across seams 11 and 13, preventing any cracking or opening of the seams to water, dirt or other contaminates. Also, it maintains a firm seal and covering for the fastener heads.

In the preferred embodiment, tape 15 will have a width of approximately 5 inches, which has been found to provide a sufficiently wide covering for seams 11 and 13, as well as the fastener heads. The flexibility of tape laminate 15 also will enable the tape to conform to any dents and irregularities in the panels and edges thereof and areas surrounding the fastener heads, to provide an effective seal therefor.

One type of tape laminate 15 found suitable is distributed under the mark Quick Seam Flashing by the Firestone Tire and Rubber Company, and identified as its part number FAC-1905.

A protective release sheet or silicone treated paper (not shown) will be applied to the exposed bottom surface 19 of the tape during shipment, which is easily pealed away from the tape for placement of the tape on the roof panels.

Figure 4:
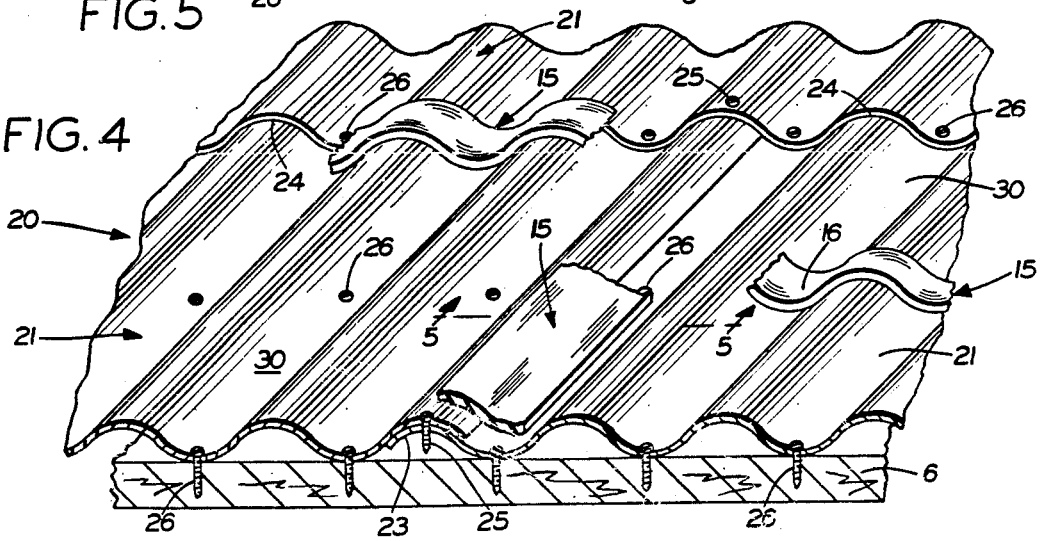
FIG. 4 is a diagrammatic fragmentary perspective view similar to FIG. 1, showing another type of a metal roof being reroofed in accordance with the invention.

Another type of metal roof using the reroofing system and method of the invention is shown in FIGS. 4 and 5 and is indicated generally at 20. Roof 20 is similar to roof 1 except that the individual metal panels indicated generally at 21, have a continuously curved sinusoidal configuration instead of the distinct ridges and flutes of panels 2. Individual panels 21 are overlapped both at their longitudinal seam 23 and transverse seam 24 and are secured to each other by fasteners 25 and to the roof structure by fasteners 26. Tape 15 is applied across both longitudinal seams 23 and transverse seams 24, and across fasteners 26 as discussed above with roof 1.

Figure 5:
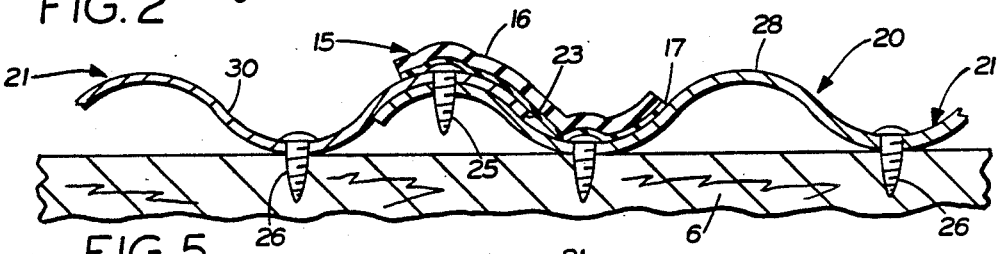
FIG. 5 is an enlarged fragmentary sectional view taken on line 5—5, FIG. 4.

In further accordance with the invention, a coating of acrylic paint indicated at 28 in FIG. 5, may be applied over tape 15 and over the remaining exposed top surfaces 30 of panels 21 to increase the weatherproof effectiveness thereof, and for certain applications to provide a pleasing aesthetic effect to the roof. Acrylic paint 28 can be applied either by a brush, roller or spray application and can be applied to roof 1 as well as to roof 20.

Also, as the tape laminate and especially the EPDM top layer 16 thereof, is exposed to the sunlight and heat, it will partially cure providing increased elasticity thereto, enabling it to stretch and contract with the expansion and contraction of the metal panels, further increasing its effectiveness as a sealant for the panel seams and attachment fasteners.

Again, one of the important features of the present invention is the manner of providing an effective, efficient, inexpensive weatherproofing for an existing metal roof requiring only the use of tape laminate 15 which extends along the longitudinal and transverse seams formed by the junction of individual metal roof panels and over the panel attachment fasteners, without requiring any additional weatherproofing components or mechanical fasteners, adhesives, or the like, other than that provided by the natural tackiness of the butyl rubber bottom layer of the tape laminate. Also, the top layer of EPDM provides an exposed non-tacky surface and increases in effectiveness when becoming partially cured by the sunlight and heat to which a metal roof is exposed.

Accordingly the improved reroofing system and method of the invention is simplified, provides an effective, safe inexpensive, and efficient method and system which achieves all the enumerated objective, provides for eliminating difficulties encountered with prior devices and methods, and solves problems and obtains new results in the art.

In the foregoing description, certain terms have been used for brevity, clearness and understanding; but no unnecessary limitation are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved metal roof reroofing system and method is constructed and used, the characteristics of the construction and method, and the advantageous, new and useful results obtained; the new and useful structures, devices, elements, arrangements, parts and combinations, and method steps, are set forth in the appended claims.

What is claimed is:

1. A metal roofing system including:

(a) a plurality of sheet metal panels attached to a structure of a building and forming seams at the junction of adjacent panels; and (b) strips of an adhesive tape laminate positioned over the seams of the adjacent panels to form a weatherproof seal thereto, said tape laminate being formed of unvulcanized EPDM and butyl rubber wherein the butyl rubber has sufficient tackiness to secure the tape laminate to the building structure.

2. The roofing system defined in claim 1 including applying a coat of acrylic paint over the tape laminate and metal panels to provide a weatherproof coating to the roof.

3. The roofing system defined in claim 1 in which the sheet metal panels are attached to the building structure by a series of fasteners; and in which strips of the tape laminate are positioned over the series of fasteners to provide a weatherproof seal for said fasteners.

4. The roofing system defined in claim 1 in which the tape laminate has an elongation of at least 600%.

5. The roofing system defined in claim 1 in which the EPDM is approximately twice the thickness of the butyl rubber.

6. The roofing system defined in claim 1 in which the EPDM is secured to the butyl rubber by the natural 7. The roofing system defined in claim 1 in which the butyl rubber is formed primarily of polyisobutylene.

8. The roofing system defined in claim 1 in which the strips of the tape laminate have a width of approximately five inches.

9. A method of reroofing an existing metal roof of the type having a plurality of sheet metal panels secured to a structure of a building in an overlapping relationship by a series of fasteners and forming seams at the junction of the overlapped adjacent panels, including the step of applying strips of an adhesive tape laminate over the seams of the overlapped adjacent metal panels and over the series of fasteners to form a weatherproof seal therefor, said tape laminate being formed of unvulcanized EPDM and butyl rubber with the butyl rubber having sufficient tackiness to secure the tape laminate to the building structure.

10. The method set forth in claim 9 including the step of coating the tape laminate and metal panels with an acrylic paint to provide a weatherproof coating for the roof.

11. The method set forth in claim 9 in which the tape laminate has an elongation of at least 600%.

12. The method set forth in claim 9 in which the strips of the tape laminate have a width of approximately five inches.

* * * * *

UNITED STATES PATENT AND TRADEMARK OFFICE

CERTIFICATE OF CORRECTION

PATENT NO. : 4,936,071

DATED : June 26, 1990

INVENTOR(S) : H. A. Karrfalt

It is certified that error appears in the above-identified patent and that said Letters Patent is hereby corrected as shown below:

Column 6, line 34

"natural" should read -- natural tackiness of said rubber. --

Signed and Sealed this

Fifth Day of May, 1992

*Attest:*

DOUGLAS B. COMER

*Attesting Officer*

*Acting Commissioner of Patents and Trademarks*